United States Patent [19]

Molly

[11] Patent Number: 5,033,358

[45] Date of Patent: Jul. 23, 1991

[54] AXIAL PISTON TYPE MOTOR

[76] Inventor: Hans Molly, Dr.
Eugen-Essig-Strasse 48, 7502
Malsch, Fed. Rep. of Germany

[21] Appl. No.: 293,243

[22] Filed: Jan. 4, 1989

[30] Foreign Application Priority Data

Jan. 4, 1988 [DE] Fed. Rep. of Germany ..... 3300031

[51] Int. Cl.[5] ..... F01B 3/00; F04B 1/12; F04D 1/30

[52] U.S. Cl. ..... 91/487; 91/504; 92/71

[58] Field of Search ..... 91/486, 487, 507, 504, 91/505, 506, 484, 485; 417/217, 229; 92/71

[56] References Cited

U.S. PATENT DOCUMENTS

| | | | |
|---|---|---|---|
| 1,975,758 | 10/1934 | Stuber . | |
| 2,956,845 | 10/1960 | Wahlmark | 92/110 |
| 3,760,692 | 9/1973 | Molly . | |
| 3,775,981 | 12/1973 | Molly . | |
| 3,933,082 | 1/1976 | Molly . | |
| 4,034,650 | 7/1977 | Molly . | |
| 4,464,979 | 8/1984 | Forster | 417/222 |

FOREIGN PATENT DOCUMENTS

| | | |
|---|---|---|
| 889851 | 10/1953 | Fed. Rep. of Germany . |
| 941246 | 4/1956 | Fed. Rep. of Germany . |
| 1051602 | 11/1961 | Fed. Rep. of Germany . |
| 1167618 | 4/1964 | Fed. Rep. of Germany . |
| 1183318 | 12/1964 | Fed. Rep. of Germany . |
| 1220735 | 7/1966 | Fed. Rep. of Germany . |
| 1775222 | 3/1971 | Fed. Rep. of Germany . |
| 2402784 | 3/1984 | Fed. Rep. of Germany . |
| 3522716 | 1/1987 | Fed. Rep. of Germany . |
| 3636243 | 5/1988 | Fed. Rep. of Germany . |
| 849676 | 11/1939 | France . |
| 1497696 | 10/1967 | France . |
| 592812 | 11/1977 | Switzerland . |

OTHER PUBLICATIONS

Dr. Jean Thoma, Olhydraulik, Entwurf und Gestaltung hydrostischer Bauteile und Anlagen, 6/1970, pp. 100–103, 112–125.

*Primary Examiner*—Leonard E. Smith
*Attorney, Agent, or Firm*—Mallinckrodt & Mallinckrodt

[57] ABSTRACT

An axial piston type motor for a hydrostatic transmission, wherein the motor is arranged to generate an output torque at the drive flange uses a Rzeppa joint (32) to couple the drive flange (10) with the cylinder barrel (16). The center of the Rzeppa joint (32) is located in the tilting point (60) between the axes of the drive flange (10) and of the cylinder barrel (16). The number of balls (42) of the Rzeppa joint (32) is equal to the number of pistons (24). The outer joint member of the Rzeppa joint (32) is formed by the drive flange (10). The balls (42) and grooves (40) of the Rzeppa joint (32) are angularly offset with respect to the ball-and-socket joints (28,30) of the pistons (24) by half the angular spacing of the ball-and-socket joints and extend up to the space between the ball-and-socket joints. In connection therewith, different possibilities of guiding the cylinder barrel directly at the barrel support (12) or indirectly at the valving body, which itself is supported on the barrel support (12), are described. The frictional forces between valving body and the cylinder barrel are reduced by pressure fields. The valving body is relieved from hydraulic forces to ensure that the valving surface may align itself with the cylinder barrel (16).

23 Claims, 8 Drawing Sheets

Fig.7
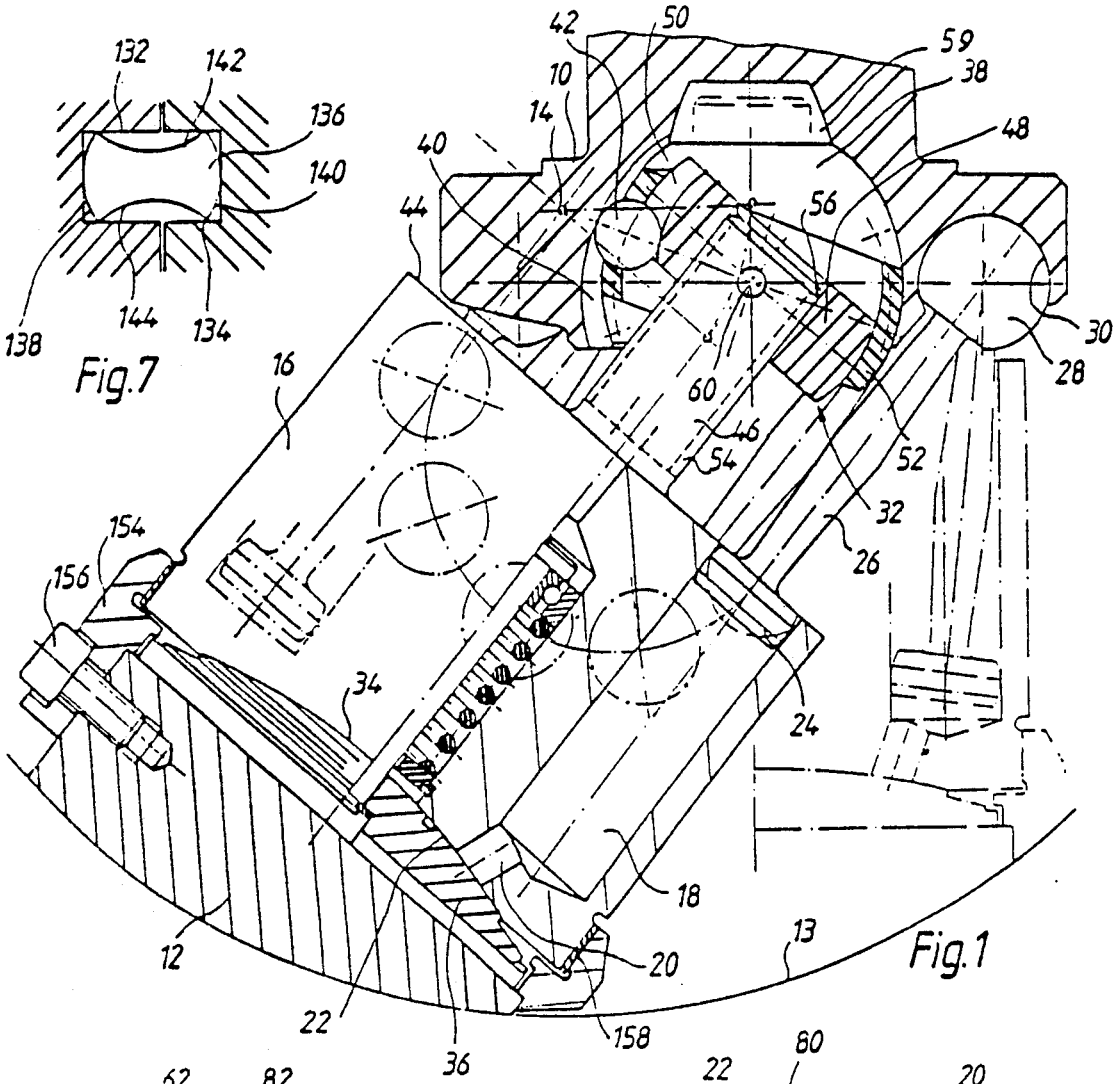
Fig.1
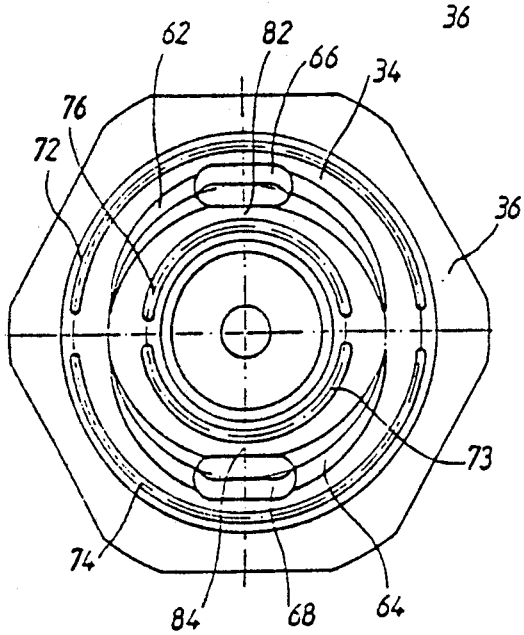
Fig.3
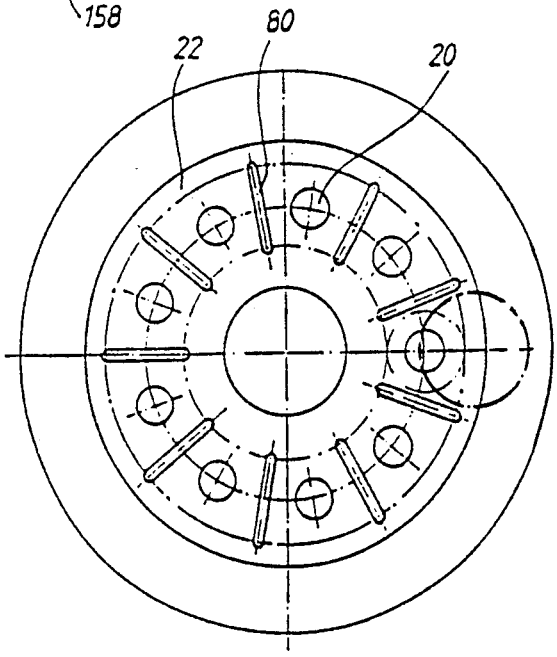
Fig. 4

68
88
70
132
90
86
66
37
36

118
126
114
102
110
106
92
122
96
134
98
104
108
94
100
112
116
124
120
39

30
28
26
152
59
150
10
18
24
20
158
68
122
37
106
154
102
114
110
130
36
168
156
84
162
154
134
164
128
158
160
170
82
166
120
108
100
132
104
112
16
66
36
39
92
12

10
16
18
20
24
26
66
68
128
130
172
174
176
178
180
182
184
186
188
190
192
194
196
198
200
202
204
206
208
210
212
214
216
218
220
222
224
226
228
230
232
234
236
240
242

AXIAL PISTON TYPE MOTOR

TECHNICAL FIELD

The invention relates to an axial piston type motor for a hydrostatic transmission with a pump and said variable volume axial piston type motor.

In one embodiment of the invention, said axial piston type motor is arranged to generate an output torque at a drive flange. Such embodiment comprises (a) a drive flange mounted in a housing for rotation about a drive flange axis, (b) a cylinder barrel having an axis and a plurality of substantially axial cylinder bores open towards said drive flange and having an end face remote from said drive flange, said axial cylinder bores communicating through passages with ports in said remote end face, (c) pistons guided in said cylinder bores of said cylinder barrel and articulated at said drive flange by a circular array of ball-and-socket joints located on a circle about said drive flange axis, (d) a barrel support pivotable relative to the drive flange about a pivot axis located in a plane perpendicular to said drive flange axis, (e) said cylinder barrel being supported in said drive flange in a tilting point, said tilting point being the intersection of the axes of said drive flange and of said cylinder barrel, and said cylinder barrel being further supported in said barrel support, (f) a valving body supported in said barrel support and retained non-rotatably therein, said valving body having a valving surface with two diametrically opposite, arcuate valving ports, each valving port extending over slightly less than 180°, one of said valving ports communicating through a passage with a fluid inlet defined in said barrel support, and the other one of said valving ports communicating through a passage with a fluid outlet defined in said barrel support, said valving surface engaging said remote end face of said cylinder barrel, (g) a Rzeppa type joint arranged to homokinetically couple said cylinder barrel with said drive flange, said Rzeppa type joint comprising an inner joint member and an outer joint member, said members having aligned longitudinal groves therein, and said joint further comprising a number of balls held in said grooves between said members to permit pivotal movement between said members about a center point, said center point coinciding with said tilting point.

A rzeppa joint is a well known homokinetic joint. It comprises an annular outer joint member having longitudinal grooves in its inner surface, and an inner joint member having longitudinal grooves in its outer surface. Balls are retained in these grooves between the outer and inner joint members. Longitudinally, the balls are held by a cage located between the outer and inner joint members. The grooves of the outer and inner joint members are curved about different centers of curvature such that the axes of the outer and inner joint members can be deflected to form an angle, while rotary motions of one member is homokinetically transmitted to the other member.

The invention also relates to an axial piston type motor, wherein valving means are hydraulically relieved from substantial axial forces to reduce the friction between the end face of the cylinder barrel and a valving surface. Such axial piston type motor may also be of the type wherein the torque is generated at the cylinder barrel, i.e. wherein the cylinders engage a swash plate through sliding shoes.

The term "stroke disc", herein, is to cover both a drive flange of an axial piston type motor, wherein the torque is generated at this drive flange, and a swash plate of an axial piston type motor, wherein the torque is generated at the cylinder barrel.

BACKGROUND ART

U.S. Pat. No. 4,034,650 shows an axial piston type machine having a cylinder barrel mounted on a shaft. At one end, the shaft is centrally supported in a drive flange by means of a ball-and-socket joint. At its other end, the shaft is mounted in a pivotable barrel support. The cylinder barrel has a circular array of axial cylinder bores. Pistons with piston rods are guided in the cylinder bores. The piston rods are articulated on the drive flange through ball-and-socket joints. A disc is arranged between the cylinder barrel and the barrel support. The surface of the disc facing the barrel support is concave-spherical. The adjacent surface of the barrel support is of convex-spherical shape complementary to the shape of the surface of the disc. The disc is restrained against rotation. The surface of the disc adjacent the end face of the cylinder barrel is provided with diametrically opposite arcuate valving ports. Each of these valving ports extends through slightly less than 180°. The valving ports serve to communicate the cylinder bores alternatingly with a fluid inlet and with a fluid outlet.

In the axial piston type motor of U.S. Pat. No. 4,034,650, the torque is generated at the swash plate. The cylinder barrel is coupled with the swash plate to rotate therewith. In the motor of U.S. Pat. No. 4,034,650, this coupling is effected by the appropriately shaped piston rods engaging, in certain angular positions, the inner walls of the cylinder bores.

In one embodiment of U.S. Pat. No. 4,034,650, the barrel support is pivotable relative to the drive flange about a pivot axis, which is laterally spaced from the rotary axis of the drive flange. Thus the barrel support is pivoted "off-center". This does not affect the tilting point, i.e. the point of intersection of the drive flange axis and the barrel axis. This design offers the advantage, that the dead volume in the cylinder bores, which has to be compressed during each revolution, is reduced. This, in turn, increases the efficiency of the axial piston motor.

A similar axial piston type motor is disclosed in U.S. Pat. No. 3,933,082.

Coupling the cylinder barrel with the drive flange through the piston rods results in non-uniform rotation of the cylinder barrel, if the motor does not work at maximum tilting angle. This is undesirable.

U.S. Pat. No. 3,760,692 discloses an axial piston motor of similar type, wherein the cylinder barrel is coupled with the drive flange through meshing toroidal or conical toothed members on the drive flange and the cylinder block. The toothed members mesh along the angle bisector between the drive flange axis and the cylinder block axis. Also here, the cylinder barrel is tilted about an off-center axis.

U.S. Pat. No. 3,775,981 relates to a hydrostatic transmission. The hydrostatic transmission comprises a pump driven by a prime mover and a variable stroke axial piston type motor fed by the pump. The pump has constant delivery during normal operation. The intake volume per revolution of the motor is variable by pivoting the cylinder barrel about an off-center pivot axis through an angle of more than 30°, such that the dead volume in the cylinders is kept as small as possible. The intake volume per revolution of the motor at maximum pivot position is a multiple of the delivery volume per revolution of the pump. The cylinder block of the motor is carried along by the drive flange again through peripherally arranged teeth in mesh in the region of the pivot axis and permitting the pivoting movement of the cylinder barrel.

U.S. Pat. No. 3,775,981 illustrates the control of such a transmission. The pressure acting in the cylinders of the pump and motor result in a torque exerted by the cylinder barrel on the barrel support about the pivot axis. This torque is counteracted by a hydraulic actuator.

The pump delivers a constant fluid flow. The pressure in the system is controled by a pressure control device. The pressure control device comprises a valve spool which is, at one end, engaged by a compression spring and, at the other end, exposed to the system pressure. The valve spool governs communication of the hydraulic actuator to either system pressure or to a reservoir. If the pressure increases, because the motor has to overcome higher resistance, the valve spool will be moved against the action of the compression spring and temporarily communicate the hydraulic actuator to the reservoir. Thus hydraulic fluid will flow out of the actuator and the cylinder barrel under the action of the said torque and the cylinder barrel will move to a position, where the barrel axis and the drive flange axis form a larger angle. The intake volume of the motor per revolution will be increased. The motor, therefore, will rotate more slowly, and the pressure in the system will drop, until a balance between compression spring force and system pressure has been reached again. The power of the motor can be varied by a control lever, by which the bias of the compression spring can be controlled.

Rzeppa joints are well known from various publications, for example U.S. Pat. No. 1,975,758; German utility model 8,402,784.3; French patent 849,676; German patent 889,851; French patent 1,497,696; German patent publication 1,183,318 and German patent application 3,636,243 and German patent publication 1,167,618.

It is also well known to use such a Rzeppa joint for coupling a cylinder barrel with the drive flange in axial piston type hydrostatic motors.

German patent publication 1,220,735 discloses an axial piston type motor, wherein the cylinder barrel is driven by the drive flange through a Rzeppa joint. In the motor of German patent publication 1,220,735, the outer joint member is a cup-shaped element provided on an axial projection of the cylinder barrel. The inner joint member is attached to a pin on the side of the drive flange. The drive flange has a central recess to accommodate the Rzeppa joint with its outer joint member. Ball-and-socket joints by which the piston rods are articulated to the drive flange are arranged in a circular array around this recess.

In the motor of German patent publication 1,220,735, the size of the Rzeppa joint is limited. This involves the risk that the Rzeppa joint is subjected to wear when transmitting the torques required to rotate the cylinder barrel. Such torques are mainly due to the frictional forces between the valving surface and the end face of the cylinder barrel and may become quite large, if the motor is operated with fluid under very high pressure. Increasing the dimensions of the Rzeppa joint results in an increase of the overall size of the whole motor. The Rzeppa joint may also interfere with the piston rods at large pivot angles and, thereby, limit the pivotal movement of the barrel support. Also, off-center pivotal movement of the barrel support and of the cylinder barrel, as explained above, is not possible with the design of German patent publication 1,220,735.

German patent application 1,775,222 shows a hydrostatic transmission with an axial piston type motor, wherein the cylinder barrel is coupled with the drive flange by means of a Rzeppa joint. In this design, the outer joint member of the Rzeppa joint is arranged in a recess of the drive flange. The inner joint member is arranged on an axial projection of the cylinder barrel. The piston rods are articulated to the drive flange in a circular array around the recess and radially spaced therefrom.

German patent application also shows a valving body engaging with a valving surface the end face of the cylinder barrel. The valving body has valving ports in its valving surface for alternately connecting the cylinders of the cylinder barrel to a fluid inlet or a fluid outlet. This valving body is held in engagement with the end face of the cylinder barrel by a bolt extending centrally through the valving body. The bolt extends into a cavity within the cylinder barrel. A compression spring is located in this cavity and abuts, at one end, the outer race of a ball bearing retained at the end of the bolt and engages, at its other end, the end face of the cavity.

German patent application 3,522,716 discloses an axial piston type motor similar to that of German patent application 1,775,222. Also in this motor, the piston rods are articulated to the drive flange in a circular array radially spaced from the central recess, in which the Rzeppa joint is arranged. Piston rods and ball-and-socket joints are arranged in the same longitudinal planes as the grooves and balls of the Rzeppa joint. A central shaft, extending through the cylinder barrel is supported with a spherical surface on the spherical inner surface of the central recess of the drive flange.

German patent 941,246 shows pressure fields in the valving surface of an axial piston type motor.

German patent 1,051,602 shows a hydrostatic axial piston type motor, wherein arcuate grooves are provided radially outwards and radially inwards of the arcuate valving ports in the valving surface. These grooves are connected to the fluid inlet or to the fluid outlet through passages drilled in the valving body below the valving surface.

DISCLOSURE OF THE INVENTION

It is an object of the invention to minimize, in an axial piston type motor of the type defined in the beginning, the radial dimensions of the drive flange and thus the mass of the whole motor.

It is a further object of the invention to permit the use of a sufficiently large Rzeppa joint, while minimizing the size of the drill flange.

It is a still further object of the invention to reduce the torque to be transmitted to the cylinder barrel through the Rzeppa joint due to friction between the valving surface and the adjacent end face of the cylinder barrel.

It is a still further object of the invention to provide an axial piston type motor of the type defined in the beginning, which permits off-center pivoting of the barrel support through large pivoting angles, the axis of the cylinder barrel passing always through a fixed tilting point on the axis of the drive shaft.

According to the invention, a hydrostatic transmission with a pump is provided, with an axial piston type motor arranged to generate an output torque at a drive flange mounted in a housing for rotation about a drive flange axis. A cylinder barrel has an axis and a plurality of substantially axial cylinder bores open towards said drive flange and has an end face remote from said drive flange. The axial cylinder bores communicate through passages with ports in said remote end face. Pistons are guided in said cylinder bores of said cylinder barrel and are articulated at said drive flange by a circular array of ball-and-socket joints located on a circle about said drive flange axis. A barrel support is pivotable relative to the drive flange about a pivot axis located in a plane perpendicular to said drive flange axis. This cylinder barrel is supported in said drive flange in a tilting point, said tilting point being the intersection of the axes of said drive flange and of said cylinder barrel. The cylinder barrel is further supported in said barrel support. A valving body is supported in said barrel support and retained non-rotatably therein. The valving body has a valving surface with two diametrically opposite, arcuate valving ports, each valving port extending over slightly less than 180°. One of said valving ports communicates through a passage with a fluid inlet defined in said barrel support. The other one of said valving ports communicates through a passage with a fluid outlet defined in said barrel support. The valving surface engages said remote end face of said cylinder barrel. A Rzeppa type joint is arranged to homokinetically coupling said cylinder barrel with said drive flange. This Rzeppa type joint comprises an inner joint member and an outer joint member. These members have aligned longitudinal grooves therein. The joint further comprises a number of balls held in said grooves between said members to permit pivotal movement between said members about a center point. This center point coincides with said tilting point. The number of balls of the Rzeppa type joint is equal to the number of pistons. The outer joint member of the Rzeppa type joint is integral with the drive flange. The balls and grooves of said Rzeppa type joint are angularly offset relative to said ball-and-socket joints by half the angular spacing between said ball-and-socket joints. The grooves extend radially into the space between said ball-and-socket joints. The pivot axis of said barrel support is substantially tangential to said circle. The cylinder barrel is axially movable relative to said inner joint member to an extent permitting tilting of said cylinder barrel about said tangential pivot axis of said barrel support.

Thus the grooves of the Rzeppa joint extend between the ball-and-socket joints of the pistons. Thereby the diameter of the Rzeppa joint can be increased, and thereby the Rzeppa joint can be made more rugged, without increasing the diameter of the drive flange. The small diameter of the drive flange permits large pivot angles of the barrel support and of the cylinder barrel. Even at such large pivot angles, the pistons and piston rods will not interfere with the Rzeppa joint. The Rzeppa joint permits axial movement of the cylinder barrel relative to the inner joint member. This, in turn, permits pivoting of the cylinder barrel about an off-center pivot axis. Such off-center pivotal movement of the cylinder barrel ensures minimum dead volume and thus high efficiency of the motor.

If the cylinder barrel axis forms a large angle with the drive flange axis, the balls in the Rzeppa joint have to make large movements in their grooves during each revolution. This results in friction and the development of heat. As, however, the axial piston type motor rotates at a low speed when the cylinder barrel is pivoted through a large angle, the speed of the balls in their grooves will not become excessively high. When the cylinder barrel axis forms a small angle with the drive flange axis, the cylinder barrel rotates at high speed. In this case, however, the balls make only small movements during each revolution. Thus also in this case the movement of the balls does not become excessively high. Therefore, the mode of use of the motor as a variable stroke motor in a hydrostatic transmission contributes to increasing the useful life of the Rzeppa joint.

Another feature of the invention is the reduction of the torque which has to be transmitted by the Rzeppa joint. This reduction of the torque is achieved by pressure fields between the valving surface and the adjacent end face of the cylinder barrel. Such pressure fields are so dimensioned that the hydraulic forces exerted thereby on the cylinder barrel are just slightly smaller than the hydraulic forces acting on the cylinder barrel due to the hydraulic pressure in the cylinders, acting on the end faces of the cylinders. The reaction force of the hydraulic forces exerted by the pressure fields between valving surface and cylinder barrel would press the valving body against the barrel support, and, thereby, would prevent movement of the valving body into alignment with the cylinder barrel. Therefore, additional pressure fields are provided between the valving body and the barrel support. Appropriate supporting means on the barrel support, in conjunction with these pressure fields, permit accurate alignment of the valving body with the cylinder barrel. The specification hereinbelow describes several designs of pressure fields between valving surface and cylinder barrel, of pressure fields between valving body and barrel support and of supporting means for supporting the valving body adjustably on the barrel support.

Thus, the invention achieves long useful life of a Rzeppa joint in axial piston type hydrostatic motors by a design permitting large diameter of the Rzeppa joint and thereby rugged construction of the joint, by a particular mode of application as a variable stroke motor of a hydrostatic transmission whereby the speed of the balls of the Rzeppa joint are kept within tolerable limits, and by reducing the torque to be transmitted by the Rzeppa joint. All this is done without impeding the other vital characteristics of the motor such as high efficiency.

Other objects and features will be apparent to anybody skilled in the art when reading the following description of preferred embodiments in conjunction with the accompanying drawings.

BRIEF DESCRIPTION OF THE DRAWINGS

FIG. 1 is a partially sectional side view of an axial piston type motor.

FIG. 3 shows the valving surface of the valving body in the axial piston type motor of FIGS. 1 and 2.

FIG. 4 shows the end face of the cylinder barrel engaging the valving surface of the valving body in the axial piston type motor of FIGS. 1 and 2.

FIG. 7 shows a detail at an enlarged scale.

BEST MODE OF CARRYING OUT THE INVENTION

Figure 5:
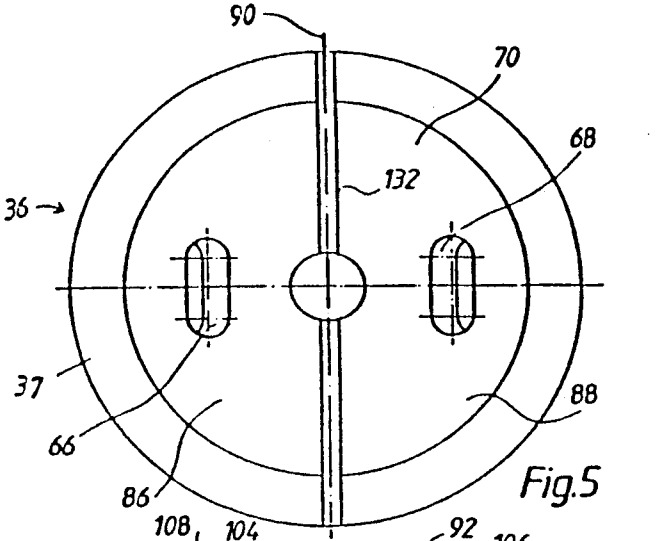
FIG. 5 shows the surface of the valving body on the side of the barrel support in the axial piston type motor of FIGS. 1 and 2.
Figure 6:
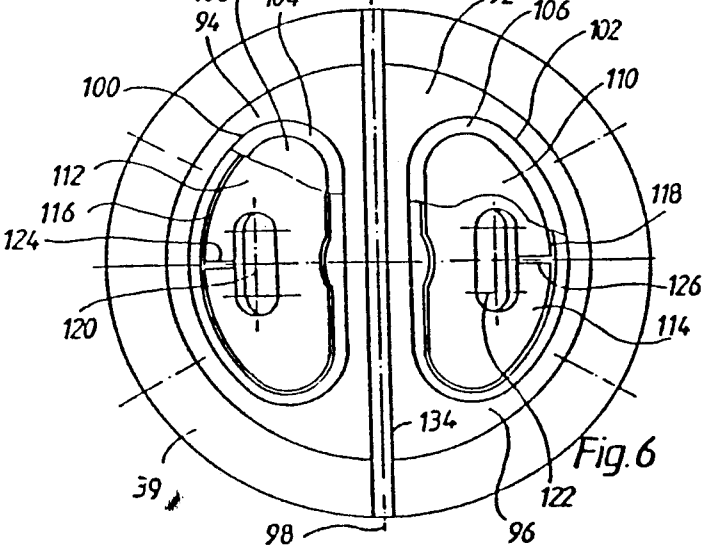
FIG. 6 shows the surface of the barrel support adjacent the valving body in the axial piston type motor of FIGS. 1 and 2.

The axial piston type motor has a drive flange 10 rotatably mounted in a casing (not shown). A barrel support 12 is pivotably mounted in the casing about an axis 14 by means of a guiding surface 13. A cylinder barrel is designated by 16. The cylinder barrel 16 has a circular array of axial cylinder bores 18, as indicated by dotted lines in FIG. 1. The cylinder bores 18 are connected to passages 20 ending in an end face 22 on the side of the barrel support. Pistons 24 are guided in the cylinder bores 18. The pistons 24 have piston rods 26. The piston rods 26 end in joint balls 28. The joint balls 28 are retained in spherical recesses 30 of the drive flange 10. Thus the piston rods 26 are articulated through ball-and-socket joints forming a circular array on the drive flange. As can be seen from FIG. 1 and in particular from FIG. 4, altogether nine cylinder bores 18 with pistons 24 and piston rods 26 as well as ball-and-socket joints 28,30 are provided. The cylinder barrel 16 is coupled with the drive flange 10 through a Rzeppa joint 32 described hereinbelow. The end face 22 of the cylinder barrel 16 engages a valving surface 34 of a valving body 36. The valving body 36 itself is supported with a planar annular surface 37 on a likewise planar annular surface 39 of the barrel support 12.

The outer joint member of the Rzeppa joint 32 is integral with the drive flange 10, which, to this end, has a central recess 38. Grooves 40 are formed in the wall of the recess 38. Balls 42 of the Rzeppa joint 32 are guided in the grooves 40. A central projection 46 is provided on the cylinder barrel 16 on the end face 44 thereof adjacent to the drive flange 10. The inner joint member 48 of the Rzeppa joint 32 is guided on this projection 46. The inner joint member 48 has grooves 50 in its outer surface. The balls 42 are also guided in these grooves 50. The balls 42 are retained by a cage 52. The cage 52 extends between the outer joint member of the Rzeppa joint 32, that is the inner surface of the recess 38 of the drive flange 10, and the inner joint member 48.

The Rzeppa joint 32 has nine grooves 40, nine grooves 50 and nine balls 42, that is exactly the number of the cylinder bores 18 and pistons 24 of the axial piston type motor. The grooves 40 are angularly offset relative to the spherical recesses 30 of the ball-and-socket joints by half the angular spacing between said ball-and-socket joints, and extend radially into the space between these recesses 30 and ball-and-socket joints.

The axial projection 46 of the cylinder barrel 16 is a splined pin. The inner joint member 48 is non-rotatably guided on the splined surface 54 with a corresponding splined inner surface 56. The number of keys in the splined surface 54 and, correspondingly, the number of key grooves in the splined inner surface 56 of the inner joint member 48 is also equal to the number of cylinder bores 18 and pistons 24 in the cylinder barrel. Thus the splined surfaces 54 and 56 have nine keys and key grooves, respectively. The keys of the splined surface 54 and the key grooves 56 of the inner joint member 48 are angularly offset with respect to the grooves 50 formed in the outer surface of the inner joint member by half the angular spacing of these outer grooves. Thus the dimensions of the inner joint member 48 can be kept small without inadmissably weakening the structure. The key grooves 56 may radially extend up to between the grooves 50.

A truncated conical recess 59 communicates with the recess 58. When the cylinder barrel 16 is pivoted back to the zero stroke position, as illustrated in FIG. 1 by dotted lines, then the tilting point 60, that is the intersection point of the axes of drive flange 10 and cylinder barrel 16, is not changed. The cylinder barrel 16, however, pivots with the barrel support 12 about the off-center pivot axis 14. The projection 46 slides in the inner joint member 48 of the Rzeppa joint 32 and moves into the recess 59. This is also indicated in FIG. 1 by dotted lines. Due to the described construction, the Rzeppa joint 32 may be constructed sufficiently rugged even with small radial dimensions of the axial piston type motor. The cylinder barrel 16 can be pivoted about an off-center pivot axis 14. An axial loading of the Rzeppa joint 32 by the cylinder barrel is prevented. The small radial dimensions of the drive flange 10 and of the cylinder barrel 16 permit a large pivot angle, as can be seen from FIG. 1. High efficiency of the axial piston type motor results from the large pivot angle and from the reduction of the dead volume.

The valving surface 34 of the valving body 36 is convex-spherical. The end face 22 of the cylinder barrel 16 of concave-spherical shape complementary thereto engages the valving surface 34. These two surfaces are illustrated in FIG. 3 and FIG. 4.

The valving surface has two crescent-shaped valving ports 62 and 64. The valving ports 62,64 extend through slightly less than 180°. The valving ports are connected through passages 66 and 68, respectively, of oval cross section to the rear surface 70 of the valving body 36 on the side of the barrel support. This surface 70 is illustrated in FIG. 5. The two valving ports 62 and 64 are surrounded radially outwardly by arcuate grooves 72 and 74, respectively, extending also through almost 180°. Arcuate grooves 76 and 78, respectively, extending through almost 180° are provided radially inwardly of the valving ports 62 and 64.

The passages 20 end in the end face 22 of the cylinder barrel 16. Radial grooves 80 extend between the passages 20. The grooves 80 are connected to the valving ports 62 or 64. Thereby oil films are formed between the grooves 80, and are limited circumferentially by the two grooves 80 just communicating with the respective valving port, and radially to the inside and to the outside by the arcuate grooves 72, 76 and 74, 78, respectively. These oil films form pressure fields with centers of force 82 and 84, respectively. These pressure fields exert forces tending to lift the cylinder barrel from the valving body 36. These forces are counteracted by forces exerted by the fluid pressure on the end faces of the cylinder bores 18.

The surface 70 of the valving body 36 consists of two halves 86 and 88 forming an obtuse angle on both sides of a center line 90. The surface 70 is supported on a surface 92 of the barrel support 12. The surface 92 is slightly roof-shaped complementary to the surface 70 of the valving body 36. Arcuate grooves 100 and 102 are provided in the two halves 94 and 96 of the surface 92 symetrically to the center line 98, one groove in each surface. Sealing rings 104 and 106 are placed in the grooves 100 and 102, respectively. Pressure areas 108 and 110, respectively, are defined by the sealing rings 104 and 106. Disks 112 and 114 are arranged on the sealing rings 104 and 106, respectively. The discs 112 and 114 have the shapes of the pressure fields 108 and 110, respectively.

The valving body 36 engages the discs 112 and 114. In their surfaces facing the valving body 36, the discs 112 and 114 have grooves 116 and 118, respectively, extending along a closed path following approximately the contour of the pressure fields 108 and 110, respectively. The discs 112 and 114 have apertures 120 and 122, respectively, communicating with the passages 66 and 68, respectively, of the valving body 36. The apertures 120 and 122 are connected through grooves 124 and 126, respectively, to the apertures 120 and 122, respectively.

The apertures 120 and 122 communicate with the pressure fields 108 and 110, respectively. These pressure fields 108 and 110 are, in turn, connected to a fluid inlet 128 and a fluid outlet 130, respectively.

In its surface 70, the valving body 36 has a straight groove 132 of rectangular cross section extending along the center line 90. A corresponding groove 134 is provided in the surface 92 of the barrel support 12 along the center line 98. The two grooves 132 and 134 together define a passage of rectangular cross section. As may be seen best from FIG. 7, a prismatic guiding element 136 is arranged in this passage. The guiding element has two convex-cylindrical side surfaces 138 and 140 engaging the bottoms of the grooves 132 and 134, respectively, and has two concave-cylindrical side surfaces 142 and 144 therebetween. This guiding element permits relative displacement of valving body 36 and barrel support 12 parallel to the center lines 90 and 98. It also permits a limited lateral compensating movement, during which the convex-cylindrical side faces 138 and 140 roll off on the bottom surfaces of the grooves 132 and 134, respectively.

The pressure fields 108 and 110 are arranged such that each of them generates a force passing through the center of force 82 and 84, respectively, of the pressure field formed between the valving surface 34 and the end face 22 of the cylinder barrel, and directed perpendicularly to this spherical valving surface 34. When the axial piston type motor is dimensioned correctly, these pressure fields and the curvature of the valving surface are chosen such that the forces exerted by the pressure fields on the cylinder barrel 16 pass through the centers of force of the forces with which the pistons 24 are supported on the drive flange 10. These centers of force are formed on the pressure and intake side, and the forces are only slightly smaller than these supporting forces. Then the forces exerted on the cylinder barrel by the fluid in the cylinder bores are nearly compensated by these pressure fields such that the cylinder barrel 16 engages the valving surface 34 with small force only. Now the pressure fields 108 and 110 generate again forces also passing through the centers of force 82,84 of the pressure fields formed between valving surface 34 and end face 22, the forces being perpendicular to the valving surface 34. Thus these forces pass substantially also through the centers of force of the supporting forces of the pistons 18 at the drive flange 10. These centers of force 150 and 152 are located on the straight line extending through the tilting point 60 parallel to the pivot axis 14 at a distance of $2r/\pi$ of the tilting point 60, when r is the radius of the circle on which the centers of the joint balls 28 are located.

In the embodiment of FIG. 1 to 6, the cylinder barrel 16 is held in the barrel support 12 by a guiding ring 154 attached by means of screws 156. The guiding ring 154 has a sliding bearing ring 158 in which the cylinder barrel 16 is mounted.

The pressure fields 108 and 110 relieve the valving body 36 from forces such that the valving body may carry out compensating movements within the framework of the guiding of FIG. 7, and may exactly align itself with the end face 22 of the cylinder barrel 16. Thus no over-determination by the spherical surfaces 22 and 34, on one hand and the sliding bearing ring 158, on the other hand, occurs.

A central stepped bore 154 forming a shoulder is provided in the central body 36. A bolt 156 having a head 158 is located in a bore 160 of the cylinder barrel 16 and extends into the stepped bore 154. The end of the bolt 156 is secured in the stepped bore 154 by means of a snap ring 162 engaging the shoulder of the stepped bore 154. An annular disc 164 is held in the bore 160 by means of a snap ring 166. A coil spring 168 engages the annular disc 164. The coil spring 168 surrounds the bolt 156 in the bore 160. The coil spring 168, at the other end, engages the outer race of a ball bearing 170. The inner race of the ball bearing 170 engages the head 158 of the bolt 156. Thus the cylinder barrel 16 is held in engagement with the valving surface 34 of the valving body 36 independently of the oil pressure. The valving body 36 is stationary. The cylinder barrel 16 rotates together with the coil spring 168. The relative motion is permitted by the ball bearing 170.

In the described axial piston type motor the Rzeppa joint exactly determines the tilting point, that is the intersection point of the axes of drive flange 10 and cylinder barrel 16. The cylinder barrel 16 is held in this tilting point 60, on one side. On the other side the cylinder barrel 16 is guided at its outside by the barrel support 12, namely through the sliding bearing ring 158. The position of the cylinder barrel 16 is thus determined unambigously. The valving body 36 is arranged to align itself with the cylinder barrel. The valving body is relieved from hydraulic forces such that also no transversal forces act on the valving body 36. The valving body 36, in turn, is guided through the planar annular surfaces 37 and 39 on the barrel support 12. Thus, in this embodiment, the cylinder barrel 16 is directly guided at the barrel support 12.

Figure 2:
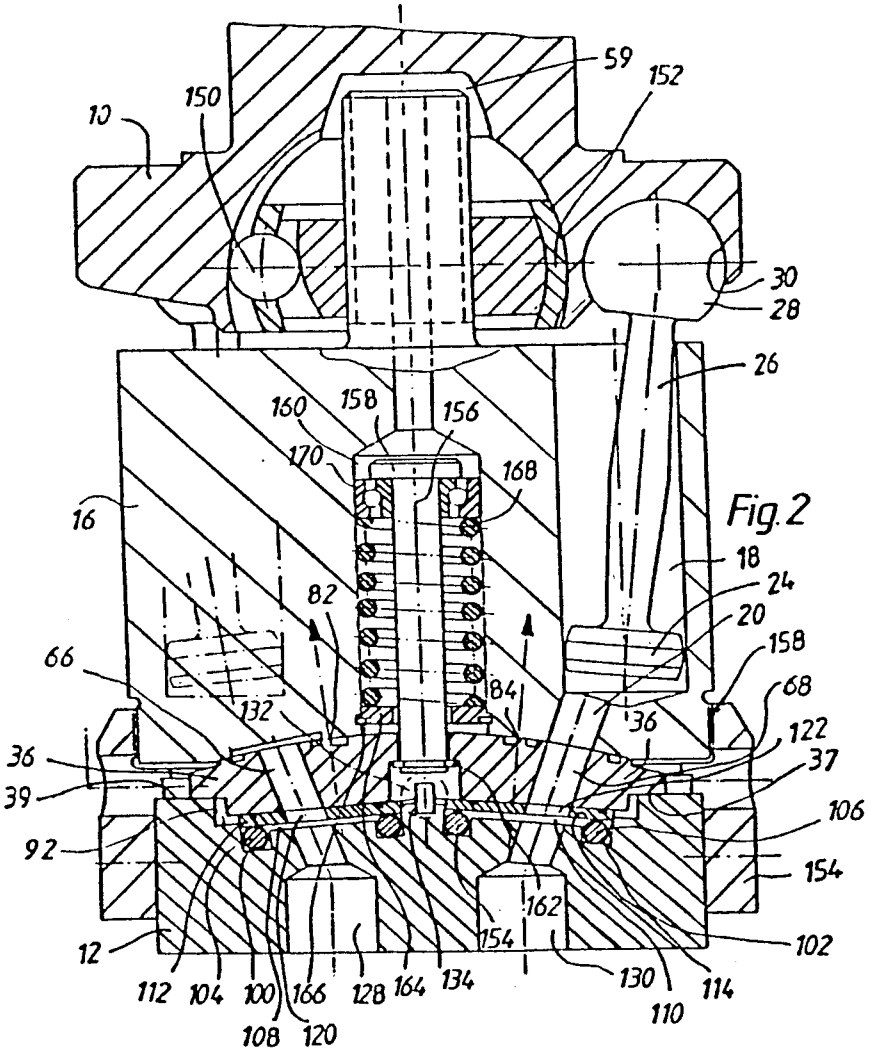
FIG. 2 shows a longitudinal section through the axial piston type motor of FIG. 1 perpendicular to the paper plane of FIG. 1.

FIGS. 8 to 12 show an axial piston type motor having a Rzeppa joint similar to FIGS. 1 and 2, wherein, however, the valving body is designed and mounted differently. Corresponding elements are designated in FIGS. 8 and 9 by the same reference numbers as in FIGS. 1 and 2, and are not described once again.

In the axial piston type motor as illustrated in FIGS. 9 to 12 the end face of the cylinder barrel 16 on the side of the valving body 172 is planar. Correspondingly, also the valving body 174 has a planar valving surface 176.

A spherical segment-shaped support body is designated by 178, having a spherical surface 180, two parallel planar surfaces 182,184 and a planar base surface 186. The cylinder barrel 16 has a central axial bore 188, similar to the axial piston type motor of FIGS. 1 and 2. A bolt 190 having a head 192 extends through the bore 188. The bolt has a threaded end 194. The support body 178 has a central bore 196. The threaded end 194 of the bolt 190 is screwed in this central bore 196. Practically this is effected by rotating the valving body 174 with the support body 178 relative to the bolt 190 held fast. An annular disc 198 supported on a snap ring 200 is arranged in the bore 188. A coil spring 202 surrounds the bolt 190 and, at one end, engages the annular disc 198. At the other end, the biased compression coil spring 202 is supported on the outer race of a ball bearing 204. The inner race of the ball bearing 204 is supported on the head 192 of the bolt 190. The threaded end 194 of the bolt 190 is flattened at its end portion 206 passing through the support body 178 on opposite sides and is guided in a slot 208 of a barrel support 210. Thereby the bolt 190 is held non-rotatably with respect to the barrel support 210. But also the support body 178 is held non-rotatably with respect to the barrel support 210.

In contrast to the embodiment illustrated in FIGS. 1 and 2, in this axial piston type motor the bolt 190 is not attached to the valving body but to the support body 178.

On the side remote from the cylinder barrel the valving body 174 has a central recess 212 with a concave-spherical surface 214 on its bottom. This concave-spherical surface is complementary to the convex-spherical surface 180 of the support body 178. The surface 214 of the valving body 174 engages the surface 180 of the support body. The support body 178, in turn, is attached to the barrel support 210.

Figure 11:
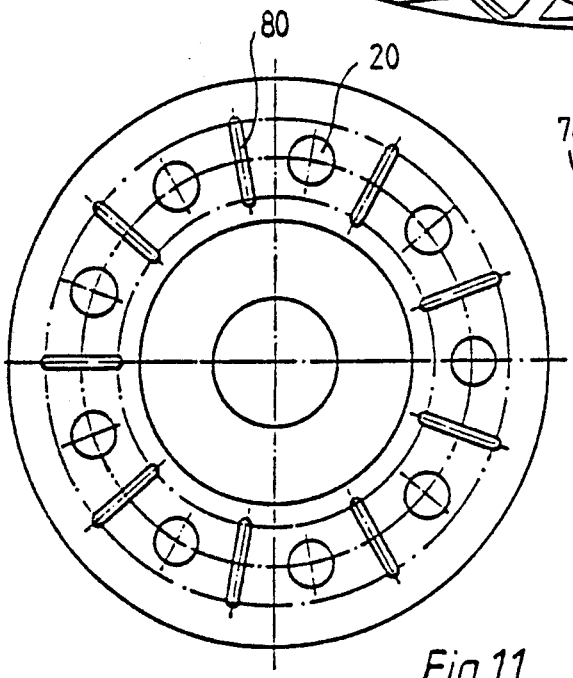
FIG. 11 is an illustration similar to FIG. 4 and shows the end face of the cylinder barrel on the side of the valving body.
Figure 10:
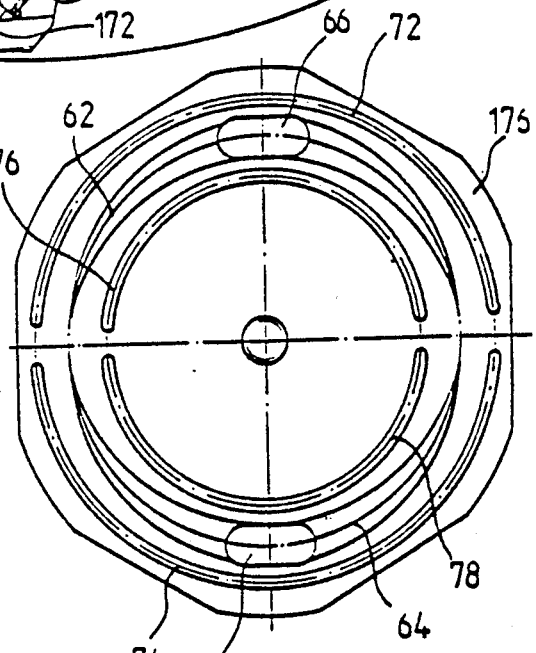
FIG. 10 is an illustration similar to FIG. 3 and shows the valving surface of the valving body.

The valving surface 176 and the end face 172 of the cylinder barrel 16 engaging the valving surface are illustrated in FIGS. 10 and 11. These surfaces are in principle constructed exactly like the corresponding surfaces of the axial piston type motor of FIGS. 1 to 7, apart from the fact that they are planar, and are thus not described in detail.

The barrel support 210 has cylindrical recesses 218 and 220 on both sides of a center line 216. Two correspondingly cylindrical projections 222 and 224 extending into these recesses 218 and 220, respectively, are provided on the valving body 174. O-rings 226 and 228 cause sealing between the projections 222,224 and the walls of the recesses 218,220. Thereby pressure fields 230 and 232 are defined. These pressure fields 230 and 232 communicate with the passages 66 and 68, respectively, of the valving body 174 and with the fluid inlet 128 and the fluid outlet 130, respectively.

Also in this axial piston type motor the cylinder barrel 16 is held through a sliding bearing ring 234 by an upwardly projecting collar 236 of the barrel support.

In the axial piston type motor of FIGS. 8 to 12, pressure fields are formed between the valving surface 176 of the valving body 174 and the end face 172 of the cylinder barrel 16. In this embodiment, these pressure fields exert axial forces on the cylinder barrel 16. These axial forces of the pressure fields counteract the axial forces exerted on the cylinder barrel 16 by the fluid in the cylinder bores 18. These axial forces are supported through the pistons 24 and piston rods 26 on the drive flange 10. The pressure fields between valving surface 176 and end face 172 are so dimensioned that the forces exerted by the fluid in the cylinder bores 18 are approximately, for example at 95% compensated and the end face 172 of the cylinder barrel 16 engages the valving surface 176 with relatively low force, just without lifting off. The circular pressure fields 230 and 232 exert axial forces on the valving body 174. The centers of force of these pressure fields 230 and 232 are located at 240 and 242, respectively. The forces pass through the center of force of the pressure fields between valving surface 176 and end face 172. Thus the valving body 174 is substantially relieved from hydraulic forces and is easily movable on the support body 178.

Thus the valving body 174 can freely align itself with the end face 172 of the cylinder barrel 16, similarly to the valving body 36 in the axial piston type motor illustrated in FIGS. 1 and 2. In contrast to the axial piston type motor of FIGS. 1 and 2, no radial force components loading the Rzeppa joint 32 occur in the axial piston type motor of FIGS. 8 and 9.

Figure 13:
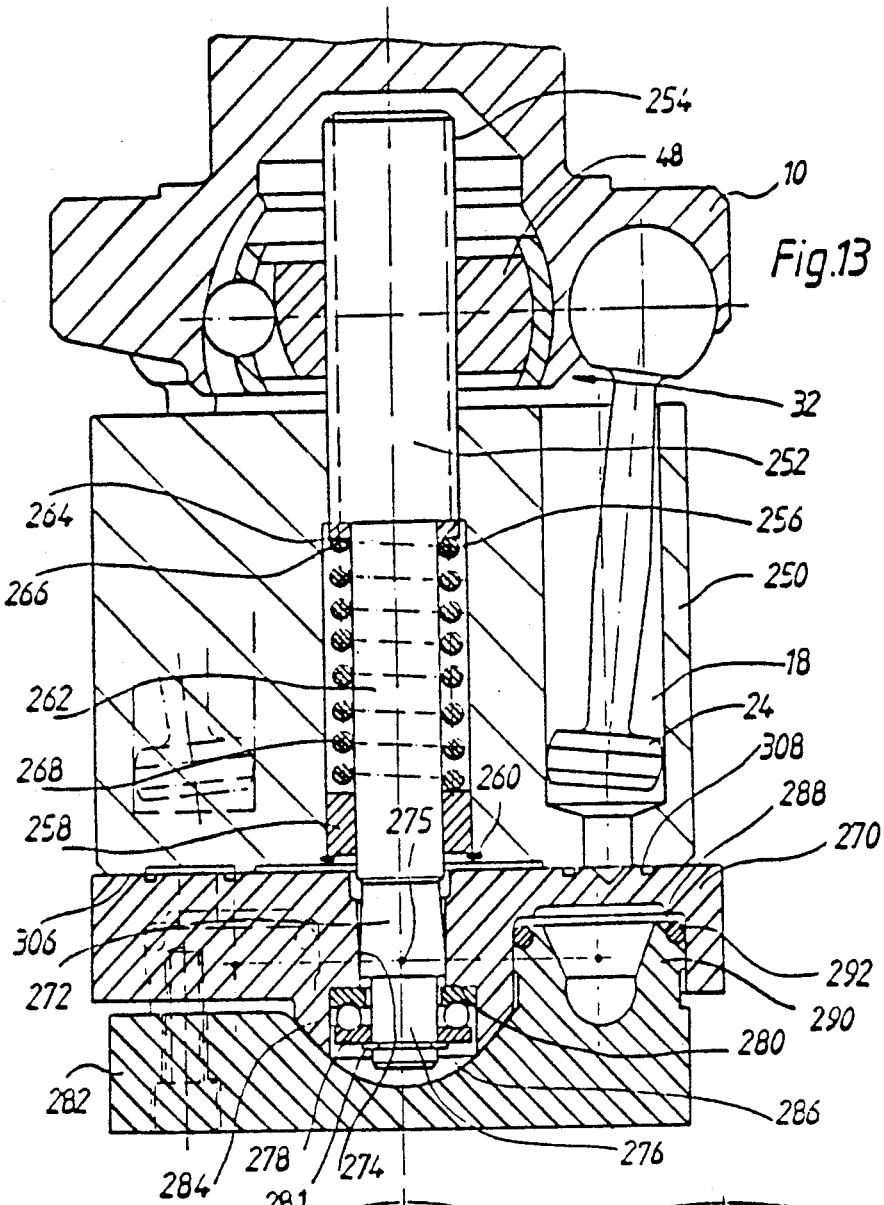
FIG. 13 is an illustration similar to FIG. 2 in a further embodiment of an axial piston type motor.
Figure 14:
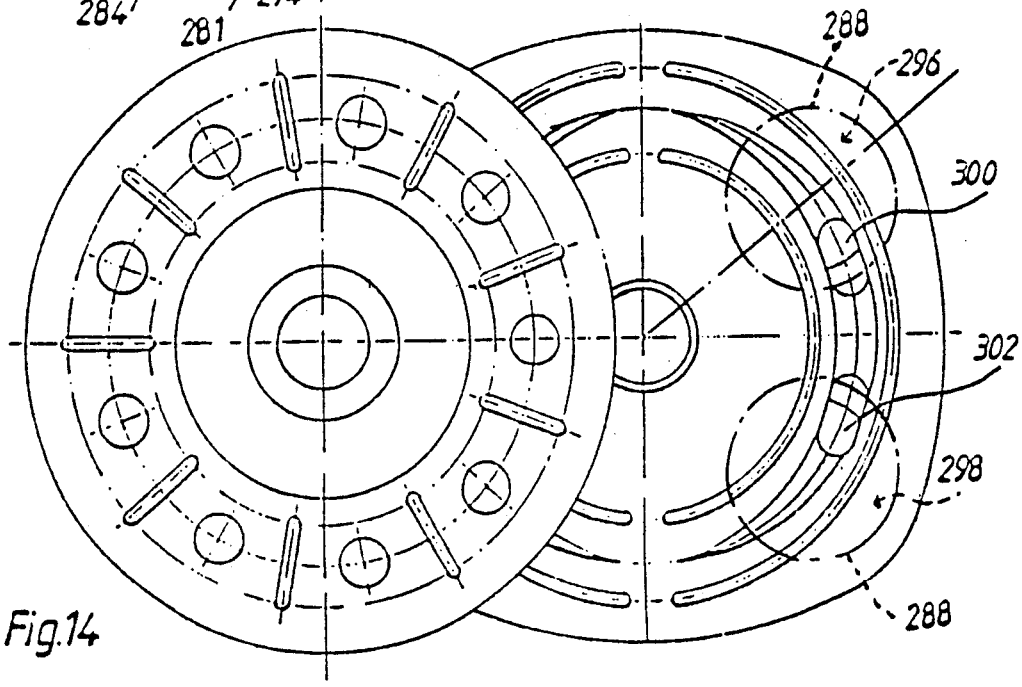
FIG. 14 is an illustration similar to FIG. 12 and shows the valving surface of the valving body and the end face of the cylinder barrel engaging this end face in an axial piston type motor of FIG. 13.

In the axial piston type motor illustrated in FIGS. 13 and 14 the cylinder barrel 25 is supported on a shaft 252. The shaft 252 is splined at one end. On this splined surface 254 on one hand, the inner joint member 48 of the Rzeppa joint 32 is non-rotatably guided, as in the axial piston type motor of FIGS. 1 and 2. On the other hand, the cylinder barrel 250 is guided on the splined surface with a bore 256 having a correspondingly splined inner surface adjacent to the joint. Adjacent to this internally splined section, the bore 256 has an enlarged smooth section extending up to the end face on the side of the control portion. A ring 258 held by a snap ring 260 is arranged in this section. The cylinder barrel 250 is mounted with this ring on a reduced diameter section 262 of the shaft 252. An annular shoulder 264 in engagement with a ring 266 is formed between the splined surface 254 of the shaft 252 and the reduced diameter section 262. A coil spring 268 is supported on the ring 266. The coil spring 268 surrounds the section 262 and engages the ring 258. Due to the bias of the coil spring 268 the cylinder barrel 250 is urged relative to the shaft 252 towards a valving body 270, that is downwards in FIG. 13. In the region of the valving body 270, the shaft 252 has a crowned or bi-conical section 272. The shaft 252 extends through a bore 274 of the valving body 270 such that the valving body 270 is held on the shaft 252 radially but is free to make limited angular aligning movements about a point 275 relative to shaft 252. Adjacent to the section 272, the shaft 252 has an end 276 of further reduced diameter. A thrust bearing 278 is attached to this end 276. The thrust bearing 278 is located in an enlarged section of the bore 274 of the valving body 270 and engages an annular shoulder 280 formed by this enlarged section. The thrust bearing 278 is held at the end of the shaft 252 by a snap ring 281.

The coil spring 268 pulls the valving body 270 through the shaft 252 and the thrust bearing 278 upwardly in FIG. 13, the thrust bearing 278 being urged against the annular shoulder 280.

The valving body 270, on the side facing the barrel support 282, has a spherical projection 284 around the bore 274 and the thrust bearing 278. This projection 284 engages a correspondingly concave-spherical or preferably conical recess 286 of the barrel support 282. The center of curvature of the spherical surface of projection 284 coincides with the point 275, about which the valving body 270 is movable. Thus, the cylinder barrel 250 is held in the valving body 270 against outside radial forces. The valving body 270, in turn, is held through projection 284 in the barrel support 282. The points about which the cylinder barrel 250 is supported in the valving body 270 and in which the valving body 270 is supported in the barrel support coincide in point 275. Therefore, there is no resultant torque. Furthermore four circular recesses 288 are formed in the valving body, as indicated in FIG. 14 by dotted lines. Cylindrical projections 290 of the barrel support 282 extend into these recesses 288. O-rings 292 are placed between the cylindrical projections 290 and the walls of the recesses 288. Thus pressure fields 296,298 (FIG. 14) are defined. The pressure fields 296 and 298 are connected through passages 300 and 302, respectively, to valving ports in a valving surface 306 engaging the end face 306 of the cylinder barrel 250.

Figure 8:
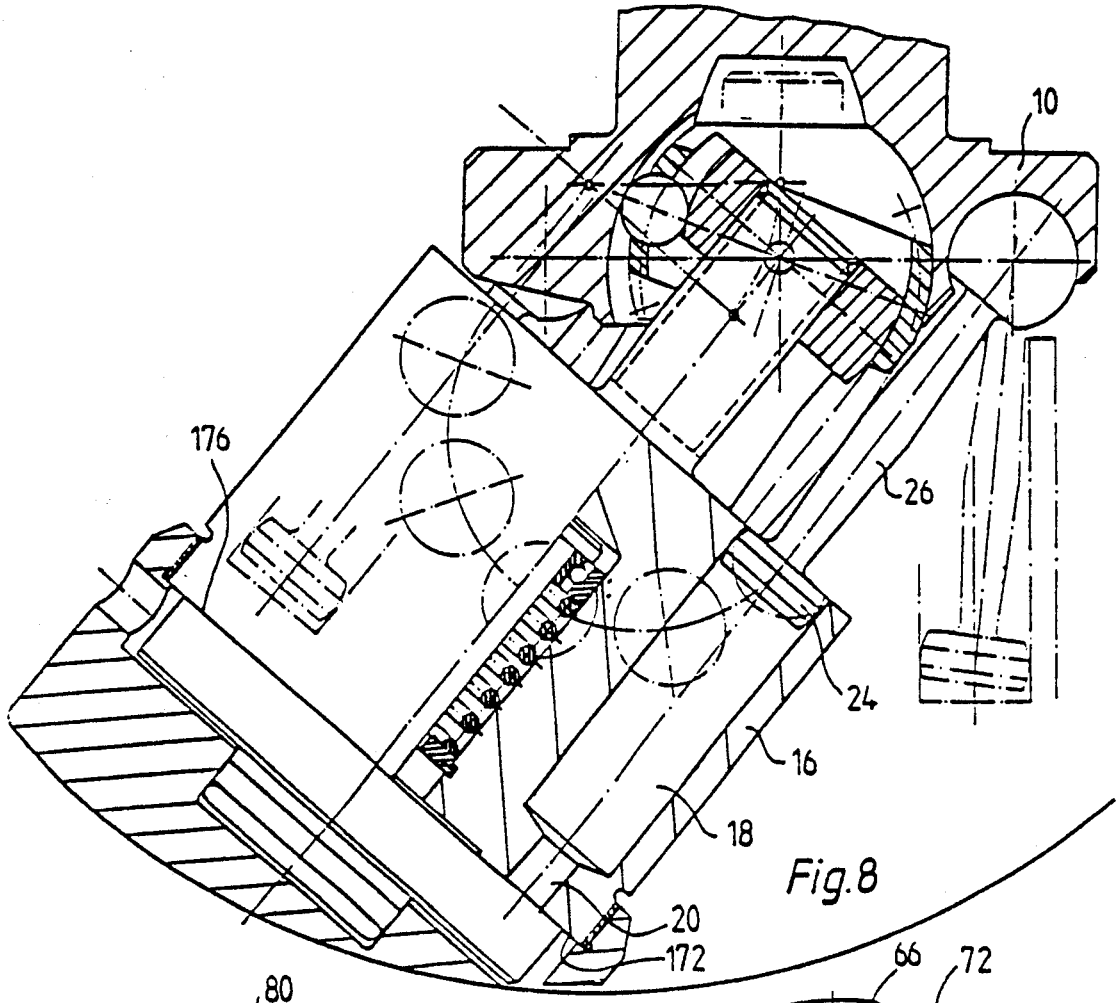
FIG. 8 is an illustration similar to FIG. 1 and shows another embodiment of an axial piston type motor.
Figures 9, 12:
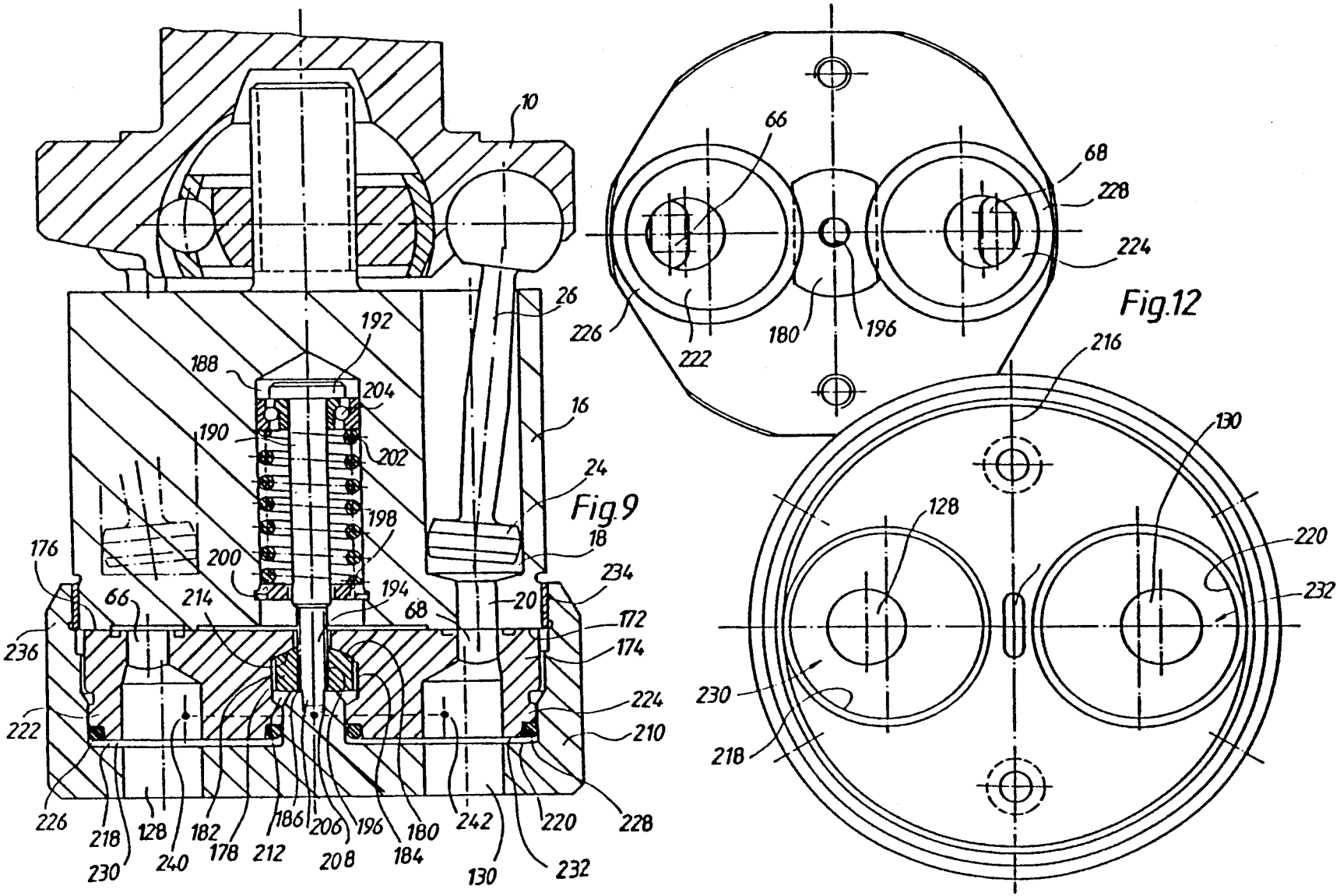
FIG. 9 is an illustration similar to FIG. 2 of the axial piston type motor of FIG. 8.
FIG. 12 shows the surface of the barrel support adjacent the valving body and the surface of the valving body on the side of the barrel support in the axial piston type motor of FIG. 8 and 9.

The Rzeppa joint 32, the drive flange 10, the cylinder bores 18 and piston 24, the end face 306 and the valving surface 308 are, in principle, constructed exactly as in the embodiments of FIGS. 1 and 2 and of FIGS. 8 and 9 and are, therefore, not described again in detail. Corresponding elements bear the same reference numbers as in the other Figures.

In the axial piston type motor illustrated in FIGS. 15 to 18 a drive flange is designated by 310. The drive flange 310 has a central spherical recess 312. A spherical segment-shaped ring 314 is located in the recess 312. A shaft 316 is longitudinally displaceably guided in the ring 314. A generally conical recess 318 is provided adjacent to the spherical segment-shaped recess 312. This recess 318 accomodates the end of the shaft 316 axially displacable in the ring 314, when the axial piston type motor is reset to small angles. A cylinder barrel 320 having a central axial bore 322 is guided on the shaft. The cylinder barrel 320 has a circular array of axial cylinder bores 324. The cylinder bores 324 are connected to passages 326 ending in an end face 328 remote from the drive flange 310. Pistons 330 are guided in the cylinder bores 324. The pistons 330 carry, at their ends extending out of the cylinder bores, joint balls 332 accomodated in spherical recesses 334 of the drive flange 310. The pistons 330 are thus articulated through ball-and-socket joints on the drive flange 310. The pistons 330 have conical piston rods 336. The shaft 316 verges, intermediate its length into a section 338 of reduced diameter. This section 338, in turn, is guided in the correspondingly reduced diameter section bore 322 in a region 340 adjacent to the end face 328. An annular shoulder 346 is formed between the section 342 of the shaft 316, on the side of the drive flange, and the section 338 of reduced diameter. Another annular shoulder 348 is formed between the wide section of the bore 322 and the reduced diameter region 340 of the bore. A biased compression coil spring 350 surrounds the shaft 316 and acts between the annular shoulders 346 and 348.

A valving surface 354 of a valving body 352 engages the end face 328. The valving body 352 has a central bore 356. The shaft 316 extends into the bore 356 and has, in the region of the bore 356, a crowned or bi-conical section 358 engaging the inner wall of the bore 356 with line contact. Thereby the valving body 352 is held radially on the shaft 316. The valving body 352 may, however, carry out a small compensating movements relative to the shaft 316 and thus to the cylinder barrel.

The end of the shaft 316 extends through a thrust bearing 360. The thrust bearing 360 is located in an enlarged section of the bore 356 which, in turn, is formed in a projecting central projection of the valving body. The thrust bearing 360 is secured on the shaft 316 by a snap ring 362 and engages an annular shoulder 364 formed by the enlarged section. A central projection of the valving body has a spherical end face 366 around the enlarged section of the bore 356. The valving body 352 is pulled by the coil spring 350 through the shaft 316 and the thrust bearing 360 against the end face 328 of the cylinder barrel 320. A barrel support 368 has a recess with a conical wall surface 370. The valving body 352 is supported with its spherical end face 366 on this conical wall surface 370. This permits alignment movement of the valving body 352 relative to the barrel support. Again, as in the embodiment of FIG. 13, the point about which the valving body 352 is pivotable on bi-conical section 358 coincides with the center of curvature of end face 366.

Figure 17:
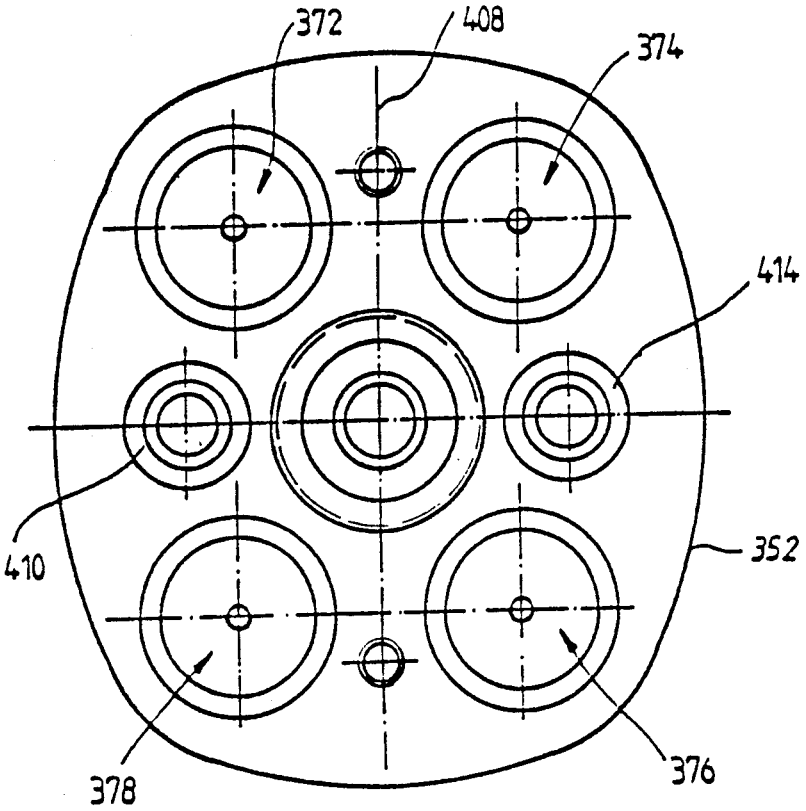
FIG. 17 shows the surface of the valving body on the side of the barrel support.
Figure 18:
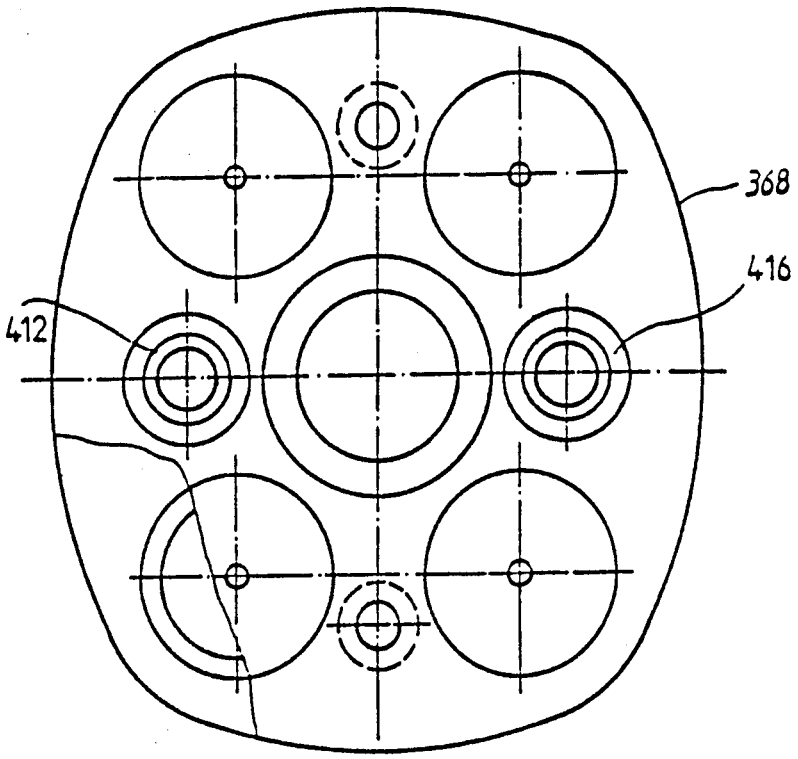
FIG. 18 shows the surface of the barrel support engaging the valving body.

In order to relive the valving body from hydraulic forces such that it can carry out this alignment movement, four pressure fields 372,374,376 and 378 are provided between barrel support 368 and valving body 352, as illustrated in FIGS. 17 and 18.

For forming the pressure fields, aligned circular recesses 380 and 382 (FIG. 15) are formed in the valving body 352 and in the barrel support 368, respectively. O-rings 384 and 386, respectively, are located in these recesses 380 and 382. Circular discs 388 are located between each pair of these O-rings 384 and 386. The disc 388 has a bore 390 through which the two pressure fields formed on both sides of the disc 388 communicate. Axially, the disc 388 extends beyond the adjacent surfaces of the valving body 352 and of the barrel support 368. The pressure field formed within the recess 380 and the O-ring 384 is connected through a bore 392 to the valving port 394 of the valving surface 354 located thereabove.

Figure 16:
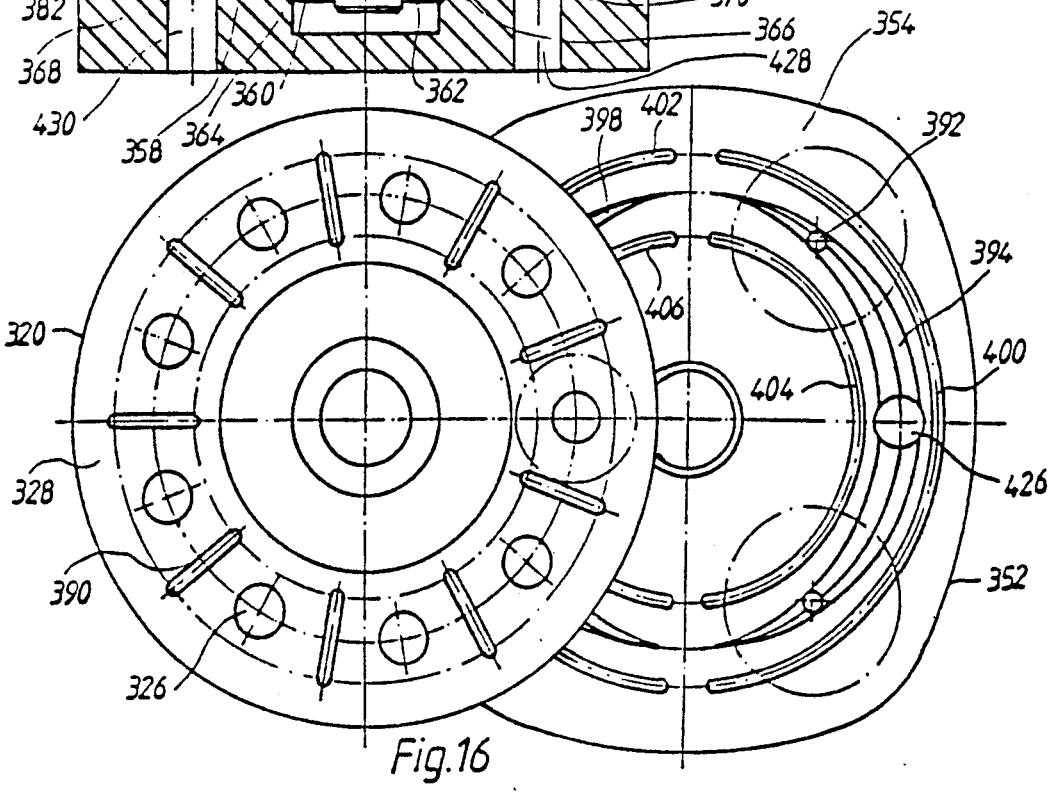
FIG. 16 is an illustration similar to FIG. 12 and shows the valving surface of the valving body and the end face of the cylinder barrel engaging this valving surface in an axial piston type motor of FIG. 15.

As can be seen from FIG. 16, radially extending grooves 396 are provided between the openings of the passages 326 in the end face 328 of the cylinder barrel 320 engaging the valving surface 354. Two crescent-shaped conrol openings 394 and 398 are formed in the valving surface 354, each extending through approximately 180°.

The two control openings 394 and 398 are surrounded by arcuate grooves 400 and 402, respectively, also extending through almost 180°. Arcuate grooves 404 and 406 exending through almost 180° each are provided radially within the conrol openings 394 and 398, respectively. Well-defined pressure fields are formed between the end face 328 of the cylinder barrel 320 and the valving surface 354 by the radial grooves 396 communicating with the valving ports 394 or 398 and by the arcuate grooves 400,404 and 402,406, respectively.

In the axial piston type motor of FIGS. 15 to 18 the function of supplying and delivering the fluid is largely separated from the function of the pressure fields 372 to 378. For the supplying and delivering of the fluid, aligned recesses 410 and 412, respectively, and 414 and 416, respectively, are formed in the valving body 352 and in the barrel support 368 between the pressure fields 372,378 and 374,376, respectively. A passage body 418 is guided through O-rings 420,422 in the recesses 414,416. The passage body 418 contains a connecting passage 424. The connecting passage is connected through a passage 426 in the valving body 352 to the control opening 394 in the central area thereof. On the other side, the connecting passage 424 communicates with the fluid outlet 428. The arrangement is similar to the left of the center line 408 with the fluid inlet 430. This arrangement for supplying and delivering fluid forms, however, also small pressure fields.

The pressure fields 374 and 376 at the right of the center line 408 in FIG. 17, are arranged such that their resulting center of force, taking into account also the pressure field resulting from the arrangement for delivering fluid, is aligned with the center of force of the pressure field formed between the arcuate grooves 400,404. Correspondingly, the pressure fields 372 and 378 at the left of the center line 408 in FIG. 17 are arranged such that their resulting center of force, taking into account also the pressure field resulting from the arrangement for supplying fluid, is aligned with the center of force of the pressure field formed between the arcuate grooves 402 and 406.

In the axial piston type motor illustrated in FIGS. 15 to 18, the cylinder barrel is not coupled with the drive flange through a Rzeppa joint but through the piston rods. In the course of each revolution the conical piston rods 336 engage the inner wall of the associated cylinder bore 324, when they go through certain angular positions, and thereby take along the cylinder barrel 320. For the rest the function is similar to the axial piston type motor of FIGS. 13 and 14. Only the construction of the pressure fields 372 to 378 is different, and the functions of the pressure fields and of the supplying and delivering of the fluid are separated.

Instead of coupling the cylinder barrel with the drive flange through the piston rods, also in an axial piston type motor as illustrated in FIGS. 15 to 18 a Rzeppa joint as used in the other embodiments may, of course, be provided.

Figure 15:
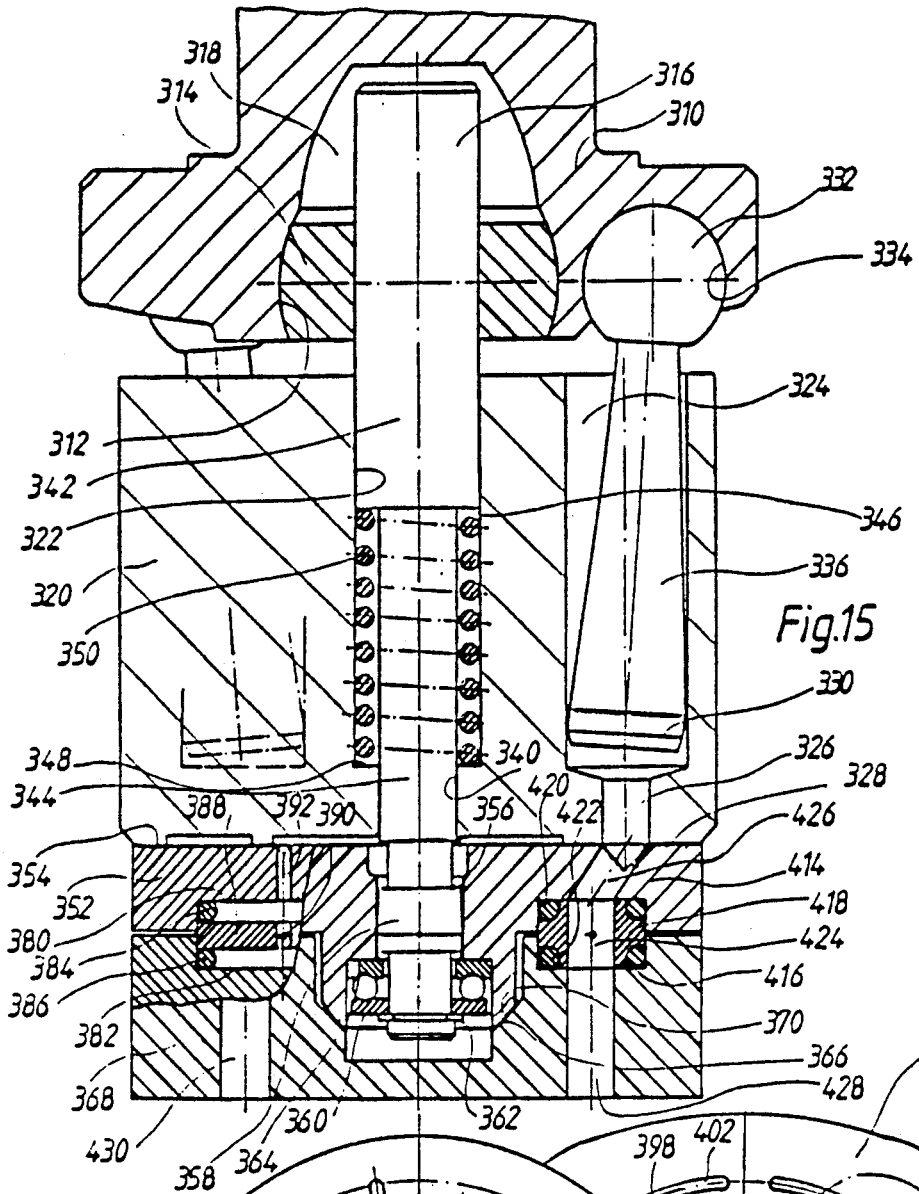
FIG. 15 is an illustration similar to FIG. 2 of another embodiment of an axial piston type motor.

In the two embodiments of FIG. 13 and of FIG. 15, the cylinder barrel is again centered in the drive flange 10 and 310, respectively, in the tilting point. On the other side, however, the cylinder barrel is not guided on the outside and is not guided at the barrel support, as in the axial piston type motors described above. In the axial piston type motors illustrated in FIGS. 13 and 15 the cylinder barrel is guided on the inside. It is not guided directly at the barrel support but first at the valving body. The valving body, in turn, is guided at the barrel support. The valving body is guided such that the valving body can align itself with the cylinder barrel. The cylinder barrel is practically guided at the barrels support "indirectly".

In all embodiments the cross sectional areas of the passages between cylinder bore and valving surface and between the valving surface and the fluid inlet and fluid outlet, respectively, are chosen substantially smaller than the cross sectional areas of the cylinder bores, the valving ports and the pressure fields. Thereby the dead volume of the axial piston type motor is reduced.

The axial piston type motor of the invention is useful wherever axial piston type motors are used and is particularly useful, as indicated, in hydrostatic transmissions. Particular embodiments of hydrostatic transmissions using axial piston type motors are shown in my U.S. Pat. No. 3,775,981.

Figure 19:
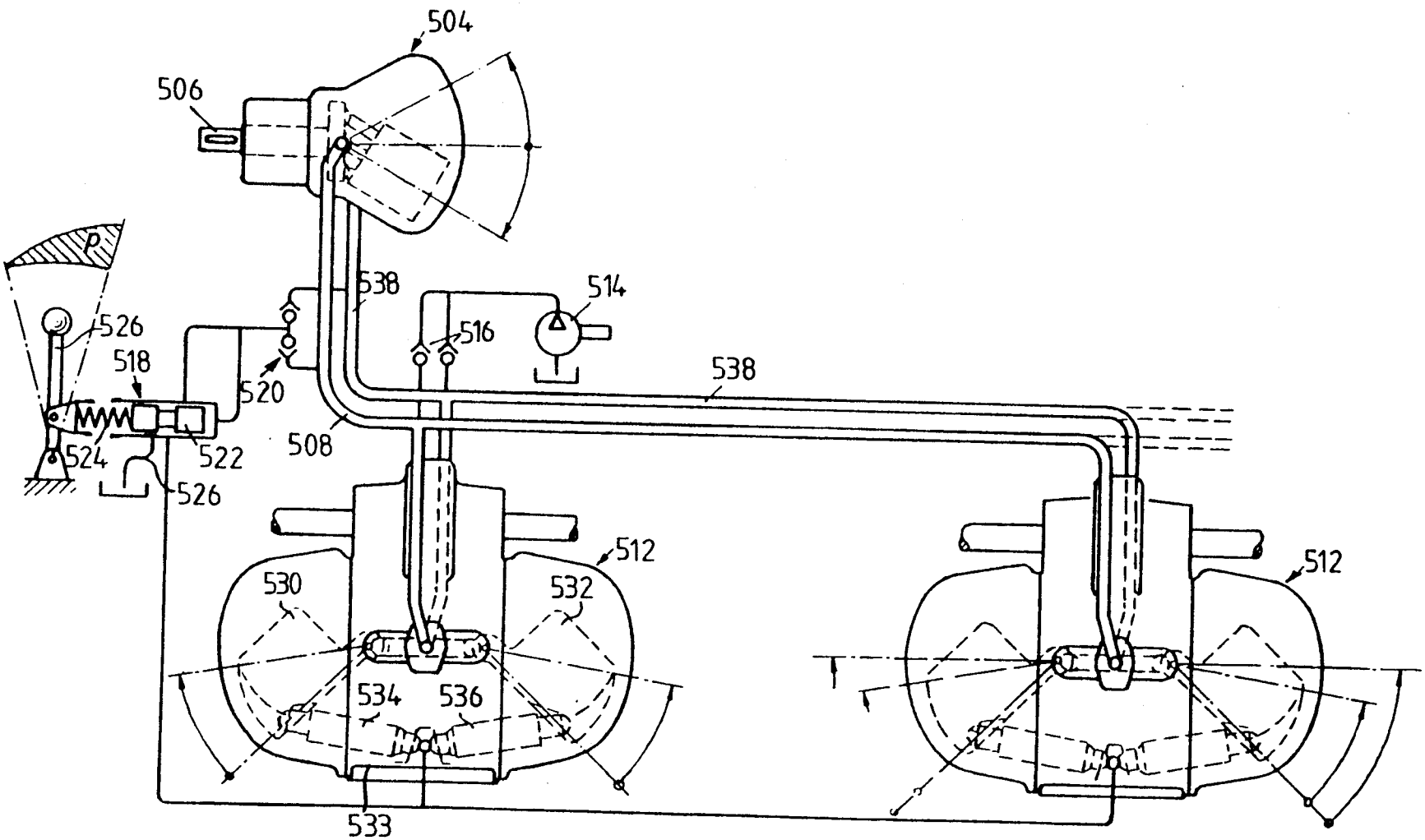
FIG. 19, a schematic diagram of a transmission in which axial piston type motors of the invention may be used.

FIG. 19 shows schematically a particular embodiment of hydrostatic transmission with which the invention can be used. This is similar to the transmission of FIGS. 12 and 13 of U.S. Pat. No. 3,775,981. A fluid pump 504 is driven by a drive shaft 506 coupled to the output of a prime mover, not shown. The pump is pivotable 30° to both sides of a zero position. The zero position corresponds to idling or stop. The pump can then be started forwards or backwards until the pump has attained its pivot position of +30° or −30°. At one pivoted position, oil is pumped through a conduit 508 to the motor assemblies, generally 510, 512, etc., and returns through conduit 538. In the opposite pivoted position, oil is pumped through conduit 538 while it returns through conduit 510. A filling pump 514 supplies filling oil into the system through check valves 516. There is a pressure regulator, generally 518, which keeps the oil pressure constant in whichever conduit 508 or 538 is serving as the supply conduit, through a check valve arrangement 520. The pressure regulator 518 includes a slide 522 which is biased by a spring 524 and controls the fluid communication between the supply conduit 508 or 538 and an outlet 526. The force exerted by the spring 524 is adjusted by a control lever 528. The greater the force applied by the spring the greater will be the pressure in the supply conduit (508 or 538) and the less the force, the less the pressure.

Each motor assembly includes two axial piston type motors 530, 532 which are articulated in pivotable frames so as to pivot in an off-center manner in a housing 533, in which the drive flanges of the respective motors are rotatably mounted for rotation about a drive flange axis. The hydraulic moments acting on the pivotable frames are taken up by the adjusting cylinders 534, 536, which adjust the angular position of the motor cylinder barrels with respect to their drive flanges. The drive flanges are coupled to shafts extending from the motor assemblies 510, 512, etc., such as to shafts 540 and 542 extending from housing 533 so that rotation of the drive flanges cause rotation of the shafts. Further details of the transmission of FIG. 19, as well as alternate transmission embodiments, are contained in the referenced U.S. Pat. No. 3,775,981 which is incorporated herein by reference.

Whereas this invention is here illustrated and described with specific reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. An axial piston type motor for a hydrostatic transmission with a pump and said variable volume axial piston type motor, said axial piston type motor being arranged to generate an output torque at the drive flange, comprising (a) a drive flange mounted in a housing for rotation about a drive flange axis, (b) a cylinder barrel having an axis and a plurality of substantially axial cylinder bores open towards said drive flange and having an end face remote from said drive flange, said axial cylinder bores communicating through passages with ports in said remote end face, (c) pistons guided in said cylinder bores of said cylinder barrel and articulated at said drive flange by a circular array of ball-and-socket joints located on a circle about said drive flange axis, (d) a barrel support pivotable relative to the drive flange about a pivot axis located in a plane perpendicular to said drive flange axis, (e) said cylinder barrel being supported in said drive flange in a tilting point, said tilting point being the intersection of the axes of said drive flange and of said cylinder barrel, and said cylinder barrel being further supported in said barrel support, (f) a valving body supported in said barrel support and retained non-rotatably therein, said valving body having a valving surface with two diametrically opposite, arcuate valving ports, each valving port extending over slightly less than 180°, one of said valving ports communicating through a passage with a fluid inlet defined in said barrel support, and the other one of said valving ports communicating through a passage with a fluid outlet defined in said barrel support, said valving surface engaging said remote end face of said cylinder barrel, (g) a Rzeppa type joint arranged to homokinetically couple said cylinder barrel with said drive flange, said Rzeppa type joint comprising an inner joint member and an outer joint member, said members having aligned longitudinal grooves therein, and said joint further comprising a number of balls held in said grooves between said members to permit pivotal movement between said members about a center point, said center point coinciding with said tilting point, wherein (h) the number of balls of the Rzeppa type joint is equal to the number of pistons, (i) the outer joint member of the Rzeppa type joint is integral with the drive flange, and (j) said balls and grooves of said Rzeppa type joint are angularly offset relative to said ball-and-socket joints by half the angular spacing between said ball-and-socket joints, said grooves extending radially into the space between said ball-and-socket joints.

2. An axial piston type machine (pump or motor) for a hydrostatic transmission with a pump and said axial piston type machine, comprising (a) a stroke disc, (b) a cylinder barrel having an axis and a plurality of substantially axial cylinder bores open towards said stroke disc and having an end face remote from said stroke disc, said axial cylinder bores communicating through passages with ports in said remote end face, (c) pistons guided in said cylinder bores of said cylinder barrel and supported on said stroke disc on a circle, said stroke disc and said cylinder barrel being relatively pivotable about a pivot axis substantially tangential to said circle, (d) a barrel support, said cylinder barrel being mounted for rotation relative to said barrel support, (e) said cylinder barrel being supported in a tilting point in said stroke disc, said cylinder barrel being further supported in said barrel support, (f) a valving body supported in said barrel support and retained non-rotatably therein, said valving body having a valving surface with two diametrically opposite, arcuate valving ports, each valving port extending over slightly less than 180°, one of said valving ports communicating through a passage with a fluid inlet defined in said barrel support, and the other one of said valving ports communicating through a passage with a fluid outlet defined in said barrel support, said valving surface engaging said remote end face of said cylinder barrel, wherein (g) said cylinder barrel is supported against outside radial forces in said valving body and (h) said valving body, in turn, is supported against outside radial forces in said barrel support, whereby said cylinder barrel is supported in said barrel support indirectly.

3. An axial piston type machine as claimed in claim 2, wherein (a) said cylinder barrel is supported in said valving body by supporting means permitting relative pivotal movement of said cylinder barrel and said valving body about a first pivot point, (b) said valving body is supported in said barrel support by supporting means permitting relative pivotal movement of said valving means and said barrel support about a second pivot point, and (c) said first and second pivot points coincide.

4. An axial piston type motor for a hydrostatic transmission with a pump and said variable volume axial piston type motor, said axial piston type motor being arranged to generate an output torque at the drive flange, comprising (a) a drive flange mounted in a housing for rotation about a drive flange axis, (b) a cylinder barrel having an axis and a plurality of substantially axial cylinder bores open towards said drive flange and having an end face remote from said drive flange, said axial cylinder bores communicating through passages with ports in said remote end face, (c) pistons guided in said cylinder bores of said cylinder barrel and articulated at said drive flange by a circular array of ball-and-socket joints located on a circle about said drive flange axis, (d) a barrel support pivotable relative to the drive flange about a pivot axis located in a plane perpendicular to said drive flange axis, (e) said cylinder barrel being supported in said drive flange in a tilting point, said tilting point being the intersection of the axes of said drive flange and of said cylinder barrel, and said cylinder barrel being further supported in said barrel support, (f) a valving body supported in said barrel support and retained non-rotatably therein, said valving body having a valving surface with two diametrically opposite, arcuate valving ports, each valving port extending over slightly less than 180°, one of said valving ports communicating through a passage with a fluid inlet defined in said barrel support, and the other one of said valving ports communicating through a passage with a fluid outlet defined in said barrel support, said valving surface engaging said remote end face of said cylinder barrel, (g) coupling means for coupling said cylinder barrel with said drive flange to rotate said cylinder barrel substantially in synchronism with said drive flange, (h) the planar remote end face of said cylinder barrel engaging the also planar valving surface of said valving body, (i) a shaft, said valving body being guided on said shaft so as to be held radially and movable to make angular alignment movements, and (j) said valving body being supported on a support means permitting alignment movements, (k) said pivot axis of said barrel support is substantially tangential to said circle and (l) said cylinder barrel is axially movable to an extent permitting tilting of said cylinder barrel about said tangential pivot axis of said barrel support.

5. An axial piston type motor as claimed in claim 4, wherein (a) said valving body is supported on said shaft through a thrust bearing, (b) said shaft being loaded by a compression spring to pull said valving body through said shaft and said thrust bearing into engagement with said remote end face of said cylinder barrel.

6. An axial piston type motor as claimed in claim 4, wherein (a) each valving port of said valving body has associated therewith a pair of circular pressure fields between said valving body and said barrel support, said pressure fields communicating with the respective valving port, (b) a separate fluid passage is provided intermediate each pair of pressure fields, said fluid passage establishing communication between said valving port and said fluid inlet or outlet, respectively, said fluid passage, by itself, also defining a pressure field, and (c) the resultant force center of each of said pairs of pressure fields and of the intermediate fluid passages being aligned with the force center of the pressure field defined by the respective valving port.

7. An axial piston type motor for a hydrostatic transmission with a pump and said variable volume axial piston type motor, comprising (a) a stroke disc, (b) a cylinder barrel having an axis and a plurality of substantially axial cylinder bores open towards said stroke disc and having an end face remote from said stroke disc, said axial cylinder bores communicating through passages with ports in said remote end face, (c) pistons guided in said cylinder bores of said cylinder barrel and supported on said stroke disc on a circle, (d) a barrel support, said cylinder barrel being mounted for rotation relative to said barrel support, said stroke disc and said cylinder barrel being relatively pivotable about a pivot axis substantially tangential to said circle, (e) said cylinder barrel being supported in a tilting point, and said cylinder barrel being further supported in said barrel support, (f) a valving body supported in said barrel support and retained non-rotatably therein, said valving body having a valving surface with two diametrically opposite, arcuate valving ports, each valving port extending over slightly less than 180°, one of said valving ports communicating through a passage with a fluid inlet defined in said barrel support, and the other one of said valving ports communicating through a passage with a fluid outlet defined in said barrel support, said valving surface engaging said remote end face of said cylinder barrel, (g) the planar remote end face of said cylinder barrel engaging the also planar valving surface of said valving body, (h) a shaft, said valving body being guided on said shaft so as to be held radially and movable to make angular alignment movements, (i) said valving body being supported on a support means permitting alignment movement, and (j) said pivot axis of said barrel support is substantially tangential to said circle.

8. An axial piston type motor as claimed in claim 7, wherein (a) said valving body is supported on said shaft through a thrust bearing, (b) said shaft being loaded by a compression spring to pull said valving body through said shaft and said thrust bearing into engagement with said remote end face of said cylinder barrel.

9. An axial piston type motor as claimed in claim 7, wherein (a) each valving port of said valving body has associated therewith a pair of circular pressure fields between said valving body and said barrel support, said pressure fields communicating with the respective valving port, (b) a separate fluid passage is provided intermediate each pair of pressure fields, said fluid passage establishing communication between said valving port and said fluid inlet or outlet, respectively, said fluid passage, by itself, also defining a pressure field, and (c) the resultant force center of each of said pairs of pressure fields and of the intermediate fluid passages being aligned with the force center of the pressure field defined by the respective valving port.

10. An axial piston type motor for a hydrostatic transmission with a pump and said variable volume axial piston type motor, said axial piston type motor being arranged to generate an output torque at the drive flange, comprising (a) a drive flange mounted in a housing for rotation about a drive flange axis, (b) a cylinder barrel having an axis and a plurality of substantially axial cylinder bores open towards said drive flange and having an end face remote from said drive flange, said axial cylinder bores communicating through passages with ports in said remote end face, (c) pistons guided in said cylinder bores of said cylinder barrel and articulated at said drive flange by a circular array of ball-and-socket joints located on a circle about said drive flange axis, (d) a barrel support pivotable relative to the drive flange about a pivot axis located in a plane perpendicular to said drive flange axis, (e) said cylinder barrel being supported in said drive flange in a tilting point, said tilting point being the intersection of the axes of said drive flange and of said cylinder barrel, and said cylinder barrel being further supported in said barrel support, (f) a valving body supported in said barrel support and retained non-rotatably therein, said valving body having a valving surface with two diametrically opposite, arcuate valving ports, each valving port extending over slightly less than 180°, one of said valving ports communicating through a passage with a fluid inlet defined in said barrel support, and the other one of said valving ports communicating through a passage with a fluid outlet defined in said barrel support, said valving surface engaging said remote end face of said cylinder barrel, (g) a Rzeppa type joint arranged to homokinetically couple said cylinder barrel with said drive flange, said Rzeppa type joint comprising an inner joint member and an outer joint member, said members having aligned longitudinal grooves therein, and said joint further comprising a number of balls held in said grooves between said members to permit pivotal movement between said members about a center point, said center point coinciding with said tilting point, wherein (h) the number of balls of the Rzeppa type joint is equal to the number of pistons, (i) the outer joint member of the Rzeppa type joint is integral with the drive flange, and (j) said balls and grooves of said Rzeppa type joint are angularly offset relative to said ball-and-socket joints by half the angular spacing between said ball-and-socket joints, said grooves extending radially into the space between said ball-and-socket joints, (k) said pivot axis of said barrel support is substantially tangential to said circle and (l) said cylinder barrel is axially movable relative to said inner joint member to an extent permitting tilting of said cylinder barrel about said tangential pivot axis of said barrel support.

11. An axial piston type motor as claimed in claim 10, wherein said inner joint member of said Rzeppa joint is guided longitudinally movably but non-rotatably relative to said cylinder barrel.

12. An axial piston type motor as claimed in claim 11, wherein (a) a splined outer surface is provided on the cylinder barrel, said inner joint member having a splined inner surface with grooves complementary to said splined outer surface and guided on said splined outer surface, (b) said splined inner surface has a number of splines and grooves equal to the number of said cylinders, and (c) the grooves of said inner surface of said inner joint member extend between the ball holding grooves in the outer surface of said inner joint member.

13. An axial piston type machine as claimed in claim 10, wherein (a) said valving surface of said valving body is convex-spherical, said remote end face of said cylinder barrel engaged thereby being of concave-spherical shape complementary thereto (b) said valving body is guided on the barrel support non-rotatably but laterally movably to permit lateral alignment of the valving body with the cylinder barrel, and (c) pressure fields are defined between said valving body and said barrel support, said pressure fields being connected to fluid pressure to generate forces which pass through the centers of force of said pressure fields and are normal to said spherical valving surface.

14. An axial piston type motor as claimed in claim 13, wherein said end face of the cylinder barrel has radial grooves therein between said ports in said remote end face.

15. An axial piston type motor as claimed in claim 14, wherein said valving surface of said valving body has arcuate grooves therein radially inward and radially outward of each said arcuate valving ports.

16. An axial piston type motor as claimed in claim 13, wherein plates having substantially the shape of said pressure fields are arranged between said barrel support and said valving body, said plates, on the side of said barrel support, being supported on O-rings, said pressure fields being defined within said O-rings and communicating with said fluid inlet or fluid outlet, respectively, said plates, in turn, engaging said valving body with seals therebetween.

17. An axial piston type motor as claimed in claim 13, wherein said passages communicating said cylinder bores and said remote end face of said cylinder barrel and said passages defined in said valving body and communicating said valving surface and a surface of said valving body engaging the barrel support have a substantially smaller cross sectional area than said pressure fields.

18. An axial piston type motor as claimed in claim 13, wherein said cylinder barrel is laterally guided in said barrel support.

19. An axial piston type motor as claimed in claim 10, wherein (a) said remote end face of said cylinder barrel and said adjacent valving surface of said valving body are planar, (b) a support body having a convex-spherical surface is provided on said barrel support, (c) said valving body having a concave-spherical surface complementary to said convex-spherical surface and supported thereon, (d) pressure fields being defined between said valving body and said barrel support.

20. An axial piston type motor as claimed in claim 19, wherein (a) said valving body has a central aperture therethrough, (b) said cylinder barrel having a central cavity extending from said remote end face, (c) a bolt engages said support body, passes through said central aperture and extends into said central cavity of said cylinder barrel, and (d) a coiled compression spring is arranged within said central cavity around said bolt, supported on said cylinder barrel through an abutment, and engages said bolt to urge said support body with its valving surface into engagement with said remote end face of said cylinder barrel, said concave and convex spherical surfaces permitting alignment of said valving body with said cylinder barrel.

21. An axial piston type motor as claimed in claim 10, and further comprising (a) a splined shaft, said cylinder barrel being non-rotatably guided on said central shaft, (b) said inner joint member of said Rzeppa joint being also guided on said splined shaft, (c) the planar remote end face of said cylinder barrel engaging the also planar valving surface of said valving body, (d) said shaft having a crowned section, said valving body being guided on said crowned section so as to be held radially and movable to make angular alignment movements, and (e) said valving body being supported on a support means permitting alignment movements.

22. An axial piston type motor as claimed in claim 21, wherein (a) said valving body is supported on said shaft through a thrust bearing, (b) said shaft being loaded by a compression spring to pull said valving body through said shaft and said thrust bearing into engagement with said remote end face of said cylinder barrel.

23. An axial piston type motor as claimed in claim 21, wherein (a) each valving port of said valving body has associated therewith a pair of circular pressure fields between said valving body and said barrel support, said pressure fields communicating with the respective valving port, (b) a separate fluid passage is provided intermediate each pair of pressure fields, said fluid passage establishing communication between said valving port and said fluid inlet or outlet, respectively, said fluid passage, by itself, also defining a pressure field, and (c) the resultant force center of each of said pairs of pressure fields and of the intermediate fluid passages being aligned with the force center of the pressure field defined by the respective valving port.

* * * * *